US010847061B1

(12) United States Patent
Chi

(10) Patent No.: US 10,847,061 B1
(45) Date of Patent: Nov. 24, 2020

(54) DISPLAY DEVICE FRAME

(71) Applicant: LITEMAX ELECTRONICS INC., New Taipei (TW)

(72) Inventor: Po-Sheng Chi, New Taipei (TW)

(73) Assignee: LITEMAX ELECTRONICS INC., New Taipei (TW)

( * ) Notice: Subject to any disclaimer, the term of this patent is extended or adjusted under 35 U.S.C. 154(b) by 0 days.

(21) Appl. No.: 16/561,480

(22) Filed: Sep. 5, 2019

(51) Int. Cl.
*G09F 13/04* (2006.01)
*G09F 1/12* (2006.01)

(52) U.S. Cl.
CPC ..... *G09F 1/12* (2013.01); *G09F 13/0413* (2013.01)

(58) Field of Classification Search
USPC ..... 40/578, 549
See application file for complete search history.

(56) References Cited

U.S. PATENT DOCUMENTS 6,466,283 B1 * 10/2002 Peng ..... G06F 1/1601 349/58
8,305,763 B2 * 11/2012 Kato ..... H05K 5/006 361/730
2008/0122993 A1 * 5/2008 Nakamichi ..... H05K 5/0213 348/789
2016/0366773 A1 * 12/2016 Esterbauer ..... G02F 1/133308
2018/0356672 A1 * 12/2018 Kim ..... G02F 1/1339
2019/0072810 A1 * 3/2019 Yang ..... G02B 6/0055
2020/0103682 A1 * 4/2020 Hu ..... G02F 1/133514

* cited by examiner

*Primary Examiner* — Kristina N Junge

(74) *Attorney, Agent, or Firm* — Schmeiser, Olsen & Watts LLP

(57) ABSTRACT

A display device frame includes a main frame body and at least a waterproof block. The main frame body is made of aluminum and has an outer frame face, an inner frame face opposing the outer frame face, at least an outer fin and at least an inner fin. The at least an outer fin is integrally coupled to the outer frame face of the main frame body. The at least an inner fin is integrally coupled to the inner frame face of the main frame body. At least a corner of the main frame body is joined by welding. The at least a waterproof block is disposed at the upper or lower edge of the welding-joined corner of the main frame body. The display device frame prevents rainwater from permeating through the junction of a display unit border, reinforces the display unit border, and enhances heat dissipation thereof.

8 Claims, 6 Drawing Sheets

DISPLAY DEVICE FRAME

BACKGROUND OF THE INVENTION

1. Field of the Invention

The present disclosure relates to frames, and in particular to a display device frame.

2. Description of the Related Art

To prevent a display unit screen from being hit under an external force and thus damaged, a display unit border is mounted around the display unit screen. If the display unit screen is located outdoors, the display unit border will prevent rainwater from seeping into the display unit screen. Considering the border has to be mechanically strong and easy to transport, the conventional display unit border is usually made of aluminum. The manufacturing process of the aluminum-made display unit border is described below. First, molten aluminum is introduced into an aluminum extrusion mold. Next, shaped, extruded aluminum blanks are pulled out of the aluminum extrusion mold. Then, the shaped, extruded aluminum blanks are appropriately cut, so as to obtain aluminum bars. Finally, the aluminum bars are joined, so as to produce the display unit border.

The aluminum bars for use in producing the conventional display unit border are joined by fastening, adhesion, welding, etc. However, junctions of the display unit border produced by fastening or adhesion are likely to admit water into the display unit border. Although junctions of the display unit border produced by welding are less likely to admit water, the junctions end up with weld spatter. The weld spatter, which are in the vicinity of the junctions, not only harms the appearance of the display unit border, but also hampers the insertion of the display unit screen or any other panel-like equipment into the display unit border. In view of this, welding is not carried out to upper or lower edges of the junction of the display unit border. Alternatively, a milling process is performed on the upper or lower edges of the junction to remove the weld spatter but at the cost of the welding-joining structure of the upper or lower edges of the junction. As a result, the upper or lower edges of the junction of the welding-based display unit border is susceptible to permeation of water. Furthermore, the conventional display unit border is also confronted with issues, such as poor heat dissipation and inadequate structural strength.

BRIEF SUMMARY OF THE INVENTION

To overcome the aforesaid drawbacks of the prior art, an objective of the present disclosure is to provide a display device frame, comprising a main frame body and at least a waterproof block. The main frame body is made of aluminum and has an outer frame face, an inner frame face, at least an outer fin, and at least an inner fin opposing the at least an outer frame face. The at least an outer fin is integrally coupled to the outer frame face of the main frame body. The at least an inner fin is integrally coupled to the inner frame face of the main frame body. At least a corner of the main frame body is joined by welding. The waterproof block is disposed at the upper edge or the lower edge of the welding-joined corner of the main frame body.

The display device frame further comprises a support frame disposed on the inner frame face of the main frame body. The support frame has a support frame face with a board thereon. The support frame face has thereon an adhesive receiving groove filled with an adhesive.

Regarding the display device frame, the support frame face has thereon an adhesive overflow-proof groove disposed beside the adhesive receiving groove and positioned proximate to an inner side of the support frame face.

Regarding the display device frame, a height of an opening of the adhesive overflow-proof groove is less than a height of an opening of the adhesive receiving groove.

Regarding the display device frame, the support frame face has thereon a water guide groove disposed beside the adhesive receiving groove and positioned proximate to an edge of the support frame face.

The display device frame further comprises a plurality of screen support elements disposed on the inner frame face of the main frame body.

The display device frame further comprises at least a waterproof air-permeable valve, wherein the main frame body has at least an air-permeable pore penetrating the outer frame face and the inner frame face of the main frame body, and the at least an waterproof air-permeable valve is disposed in the at least an air-permeable pore of the main frame body.

Regarding the display device frame, the upper edge or the lower edge of the welding-joined corner of the main frame body is joined by groove welding.

Regarding the display device frame, the at least an outer fin is in a plural number, and the outer fins are parallel and spaced apart.

Regarding the display device frame, the at least an inner fin is in a plural number, and the inner fins are parallel and spaced apart.

The display device frame prevents rainwater from permeating through the junction of a display unit border, reinforces the display unit border, and enhances heat dissipation thereof.

DETAILED DESCRIPTION OF THE INVENTION

To facilitate understanding of the object, characteristics and effects of this present disclosure, embodiments together with the attached drawings for the detailed description of the present disclosure are provided.

Figure 1:
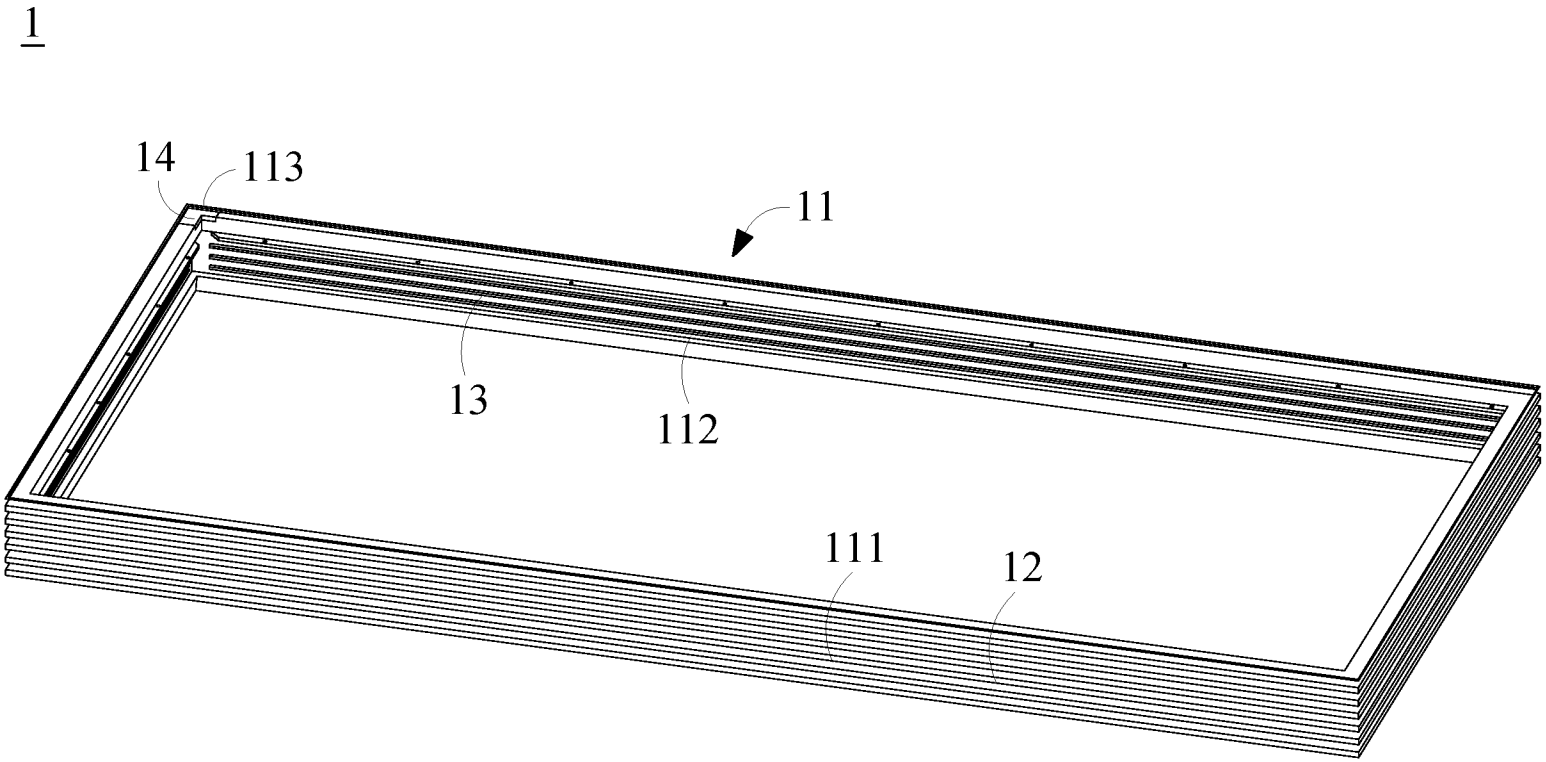
FIG. 1 is a perspective view of a display device frame according to the first embodiment of the present disclosure.
Figure 2:
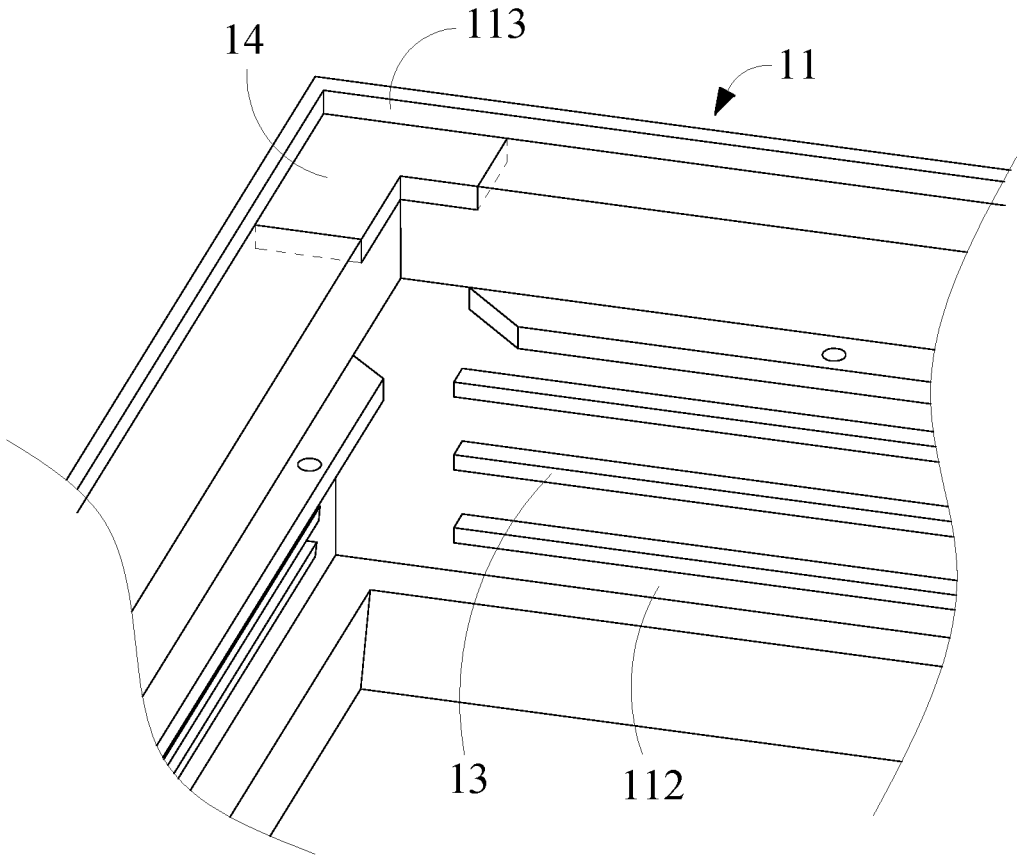
FIG. 2 is an enlarged, partial view of the display device frame according to the first embodiment of the present disclosure.
Figure 3:
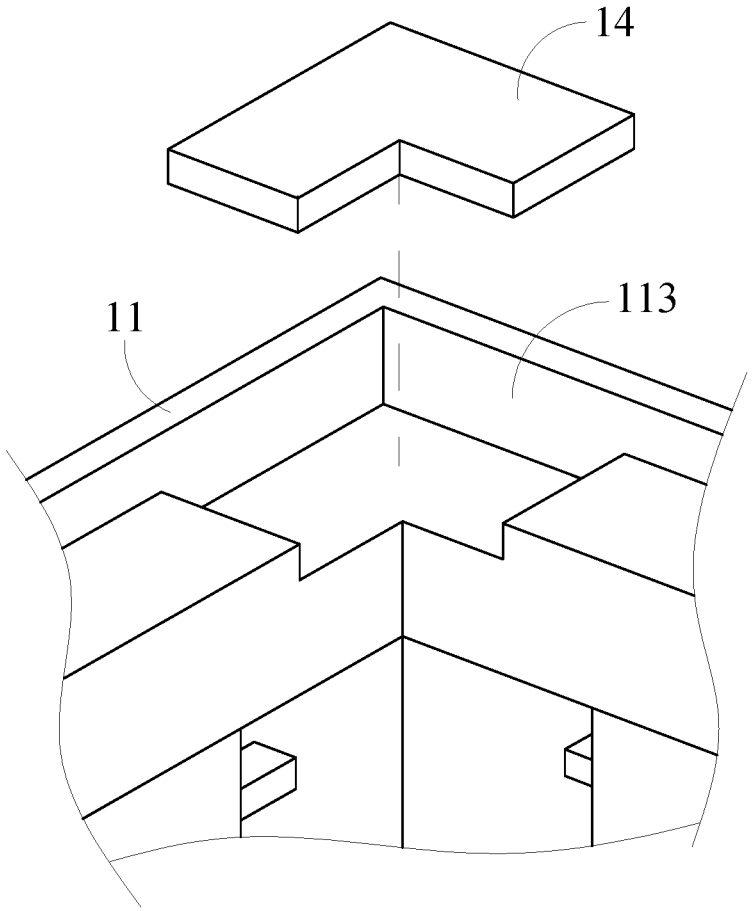
FIG. 3 is an enlarged, partial, exploded view of the display device frame according to the first embodiment of the present disclosure.

The first embodiment of the present disclosure provides a display device frame 1. Referring to FIGS. 1-3, the display device frame 1 comprises a main frame body 11 and a waterproof block 14.

The main frame body 11 is made of aluminum and has an outer frame face 111, an inner frame face 112, a plurality of outer fins 12 and a plurality of inner fins 13. The outer frame face 111 and the inner frame face 112 oppose each other. The outer fins 12 are integrally coupled to the outer frame face 111 of the main frame body 11. The inner fins 13 are integrally coupled to the inner frame face 112 of the main frame body 11. A corner 113 of the main frame body 11 is joined by welding. The waterproof block 14 is disposed at the upper edge (or the lower edge, depending on the angle of view) of the welding-joined corner 113 of the main frame body 11 and adapted to block water. Even though welding is not carried out to the upper edge of the corner 113 to avoid producing weld spatter, the waterproof block 14 prevents water from permeating through the upper edge of the corner 113 of the main frame body 11, so as to prevent rainwater from permeating through the junction of the conventional display unit border.

In the first embodiment, the manufacturing of the main frame body 11 comprises the steps of: pulling extruded aluminum bars out of an aluminum extrusion mold by a conventional aluminum extrusion process; bending each said extruded aluminum bar with a bending machine such that it takes on a frame-like pattern; and joining the two ends of the aluminum bar by welding to form a corner of the main frame body 11. Hence, welding is carried out exclusively to the corner of the main frame body 11. In a variant embodiment, the aluminum extrusion process either involves producing four aluminum bars or involves cutting a long aluminum bar into four short aluminum bars and then joining the four short aluminum bars by welding, thereby requiring welding to be carried out to four corners; as a result, to prevent rainwater from permeating through the four corners of the main frame body 11, the waterproof block 14 is mounted on the upper edge or lower edge of each of the four corners of the main frame body 11. Therefore, the quantity of the waterproof block 14 is subject to changes as needed but is not restricted to the first embodiment.

In the first embodiment, the waterproof block 14 is disposed on the corner 113 by adhesion to ensure that the main frame body 11 is visually attractive. In a variant embodiment, the waterproof block 14 is disposed on the corner 113 by a conventional means of fixation, for example, fastening, but is not restricted to the first embodiment.

In the first embodiment, the outer fins 12, the inner fins 13 and the waterproof block 14 each reinforce the display device frame 1, and, in particular, both the outer fins 12 and the inner fins 13 are integrally coupled to the main frame body 11 to thereby further reinforce the display device frame 1. Furthermore, the display device frame 1 has only an outer fin 12 and an inner fin 13 at the very least, so as to reinforce the display device frame 1. Hence, in another variant embodiment, the quantity of the outer fins 12 and the inner fins 13 is subject to changes as needed but is not restricted to the first embodiment.

In the first embodiment, the outer fins 12 and the inner fins 13 are capable of dissipating heat, and, in particular, the outer fins 12 and the inner fins 13 are parallel, spaced apart and disposed on the outer frame face 111 and the inner frame face 112, respectively, such that the outer fins 12 and the inner fins 13 can dissipate heat better because of the aforesaid arrangement. When a display unit or liquid crystal screen is mounted on the display device frame 1, the high brightness of the screen leads to generation of heat. The structure and arrangement of the outer fins 12 and the inner fins 13 is similar to that of computer cooling fins; hence, the heat generated from the display unit or liquid crystal screen can be dissipated from the display device frame 1, using the outer fins 12 and the inner fins 13. According to the prior art, the conventional display unit border comes with a cooling fan in order to achieve heat dissipation. By contrast, according to the present disclosure, the outer fins 12 and the inner fins 13 are sufficient to enable the display device frame 1 to dissipate heat sufficiently, thereby rendering any additional cooling fan unnecessary.

Furthermore, the corner 113 of the main frame body 11 is welding-joined by groove welding. The waterproof block 14 is mounted on the upper edge or lower edge of the welding-joined corner 113; hence, the corner 113 is preferably welded by groove welding. The advantage of groove welding is that it does not lead to weld spatter which might otherwise hinder the attachment of the waterproof block 14 to the corner 113. Furthermore, groove welding is conducive to enhancement of flatness of edges of the corner 113 and thereby adhesion of an acrylic board or any other transparent board for protecting the display unit to the edges of the main frame body 11. In a variant embodiment, general welding is carried out to the corner 113, but the first embodiment is not limited thereto.

Figure 4:
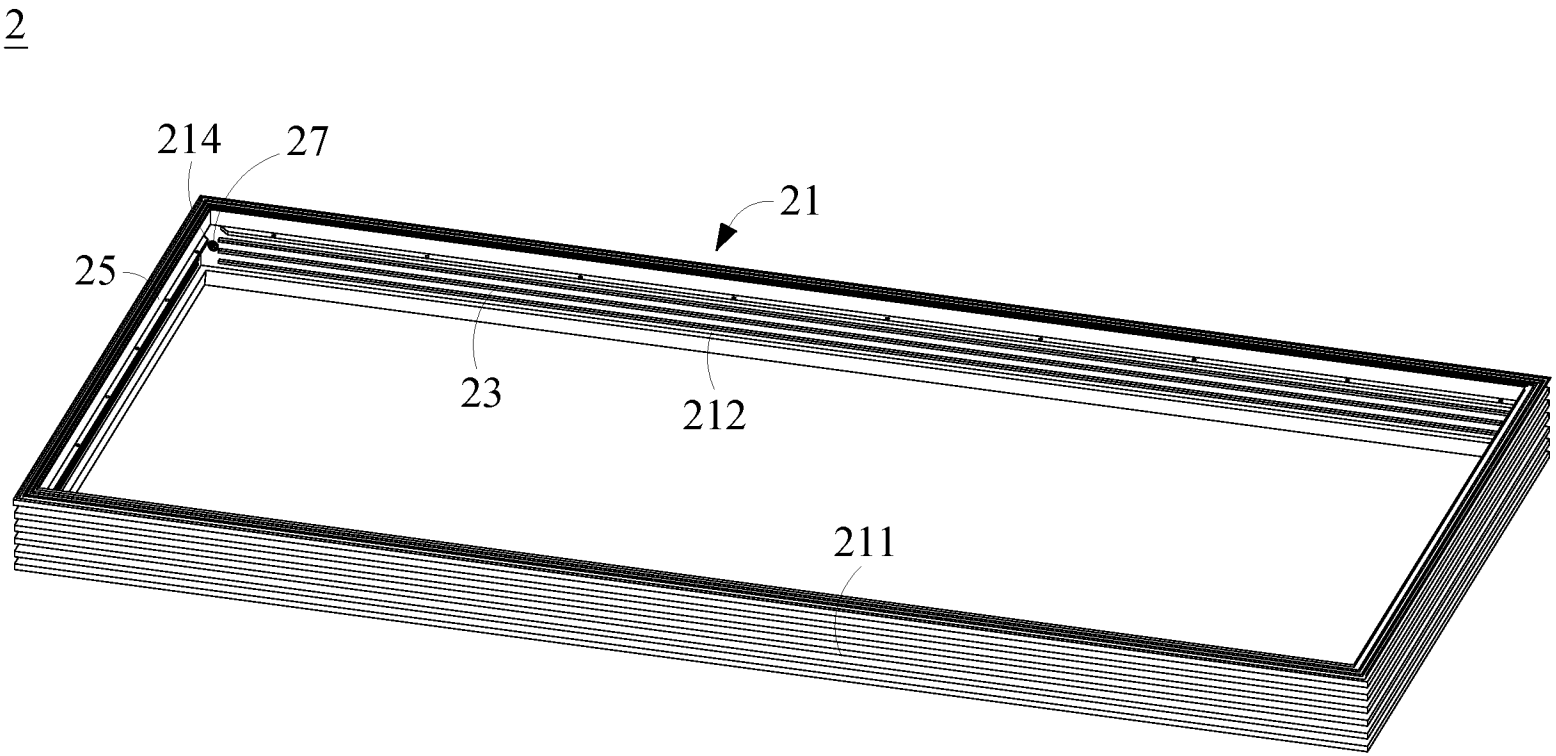
FIG. 4 is a perspective view of another display device frame according to the second embodiment of the present disclosure.
Figure 5:
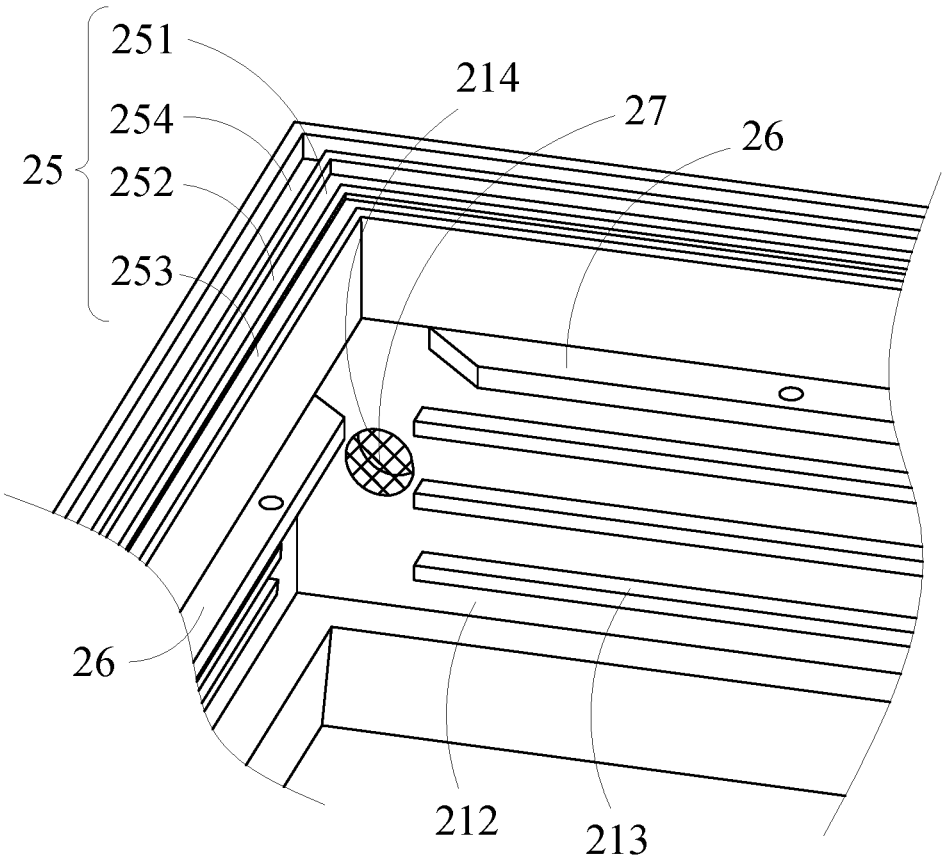
FIG. 5 is an enlarged, partial view of the display device frame according to the second embodiment of the present disclosure.
Figure 6:
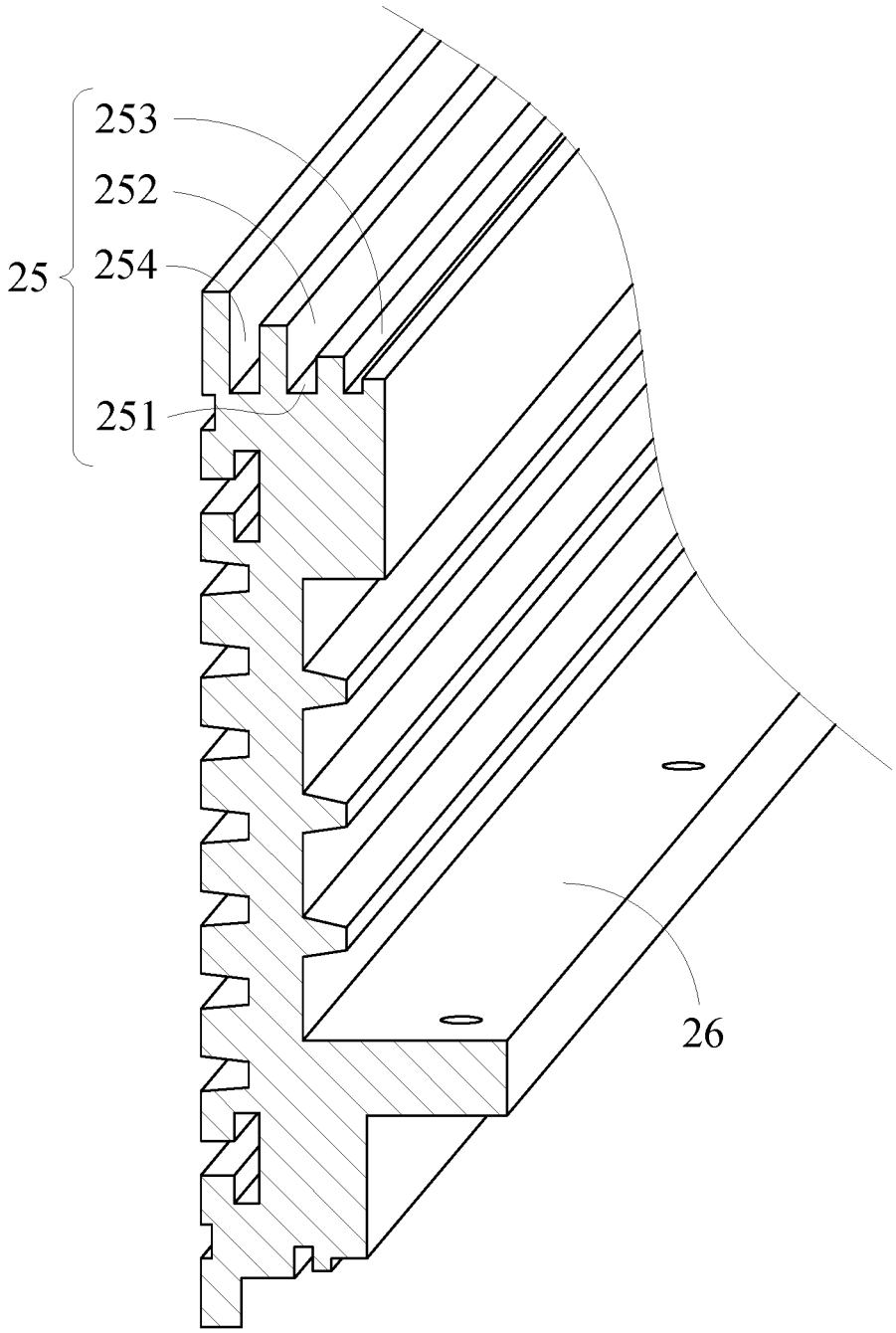
FIG. 6 is an enlarged, partial, cross-sectional view of the display device frame according to the second embodiment of the present disclosure.

The second embodiment of the present disclosure provides a display device frame 2. Referring to FIGS. 4~6, the technical features which distinguish the display device frame 2 in the second embodiment from the display device frame 1 in the first embodiment in terms of structures and functions are described below. the display device frame 2 further comprises a support frame 25. Referring to FIGS. 5 and 6, the support frame 25 is disposed on the inner frame face 212 of the main frame body 21 and has a support frame face 251. An acrylic board or any other transparent board for protecting the display unit is disposed on the support frame face 251. The support frame face 251 has thereon an adhesive receiving groove 252. The adhesive receiving groove 252 is filled with an adhesive such that the acrylic board or transparent board can be adhered to the support frame face 251.

Referring to FIGS. 5 and 6, the support frame face 251 has thereon an adhesive overflow-proof groove 253. The adhesive overflow-proof groove 253 is disposed beside the adhesive receiving groove 252 and positioned proximate to the inner side of the support frame face 251. After the adhesive receiving groove 252 has been filled with adhesive and the acrylic board or transparent board has been adhered to the support frame face 251, any surplus adhesive is admitted to the adhesive overflow-proof groove 253 rather than squeezed by the acrylic board or transparent board to therefore overflow the display device frame 2 and harm the appearance of the display device frame 2. To improve the adhesive overflow-proof groove 253 in the second embodiment, the height of the opening of the adhesive overflow-proof groove 253 is less than the height of the opening of the adhesive receiving groove 252 such that the surplus adhesive can flow into the adhesive overflow-proof groove 253 smoothly. In a variant embodiment, the height of the opening of the adhesive overflow-proof groove 253 is not limited thereto but is subject to changes as needed.

Referring to FIGS. 5 and 6, the support frame face 251 has thereon a water guide groove 254. The water guide groove 254 is disposed besides the adhesive receiving groove 252 and positioned proximate to the support frame face 251. If the display device frame 2 is damaged under an external force or has its waterproofing function diminished for any reason, allowing external water to permeate into the display device frame 2, the water guide groove 254 will guide the permeating water to a specific position (when the display device frame 2 is upright, the water guide groove 254 guides the permeating water to the bottom of the display device frame 2). Then, the permeating water will be discharged, with a water discharging valve (not shown), from the display device frame 2, thereby preventing the external water from remaining inside the display device frame 2.

Referring to FIGS. 5 and 6, the display device frame 2 further comprises a plurality of screen support elements 26 for supporting the screen panel. The screen support elements 26 in the second embodiment are implemented in the form of four bars. The screen support elements 26 are disposed at four points of the inner frame face 212 of the main frame body 21, respectively, to jointly form a frame structure. The screen support elements 26 are disposed nearer to the center of the inside of the main frame body 21 than the support frame 25. However, in a variant embodiment, the shape, structure, arrangement and quantity of the screen support elements 26 are not restricted to the second embodiment but are subject to changes as needed.

Referring to FIGS. 4 and 5, the display device frame 2 further comprises a plurality of waterproof air-permeable valves 27. The main frame body 21 has a plurality of air-permeable pores 214. The air-permeable pores 214 penetrate the outer frame face 211 and the inner frame face 212 of the main frame body 21. The waterproof air-permeable valves 27 are disposed in the air-permeable pores 214 of the main frame body 21. Owing to the waterproof air-permeable valves 27, not only is the heat generated from the display unit or liquid crystal screen mounted inside the display device frame 2 dissipated from the display device frame 2, but external water is also prevented from permeating through the air-permeable pores 214 into the main frame body 21. The air-permeable pores 214 correspond in position to the waterproof air-permeable valves 27, respectively. The air-permeable pores 214 and the waterproof air-permeable valves 27 are in the number of at least one, which is not restricted to the second embodiment but is subject to changes as needed.

Therefore, the display device frame prevents rainwater from permeating through the junction of the display unit border, enhances dissipation of heat from the display unit border, reinforces the display device frame by means of the outer fins, inner fins and waterproof block, and further enhances heat dissipation by means of the arrangement of the outer fins and inner fins. The adhesive receiving groove of the support frame is filled with adhesive whereby an acrylic board or any other transparent board for protecting the display unit can be adhered to the support frame face. The adhesive overflow-proof groove of the support frame prevents any surplus adhesive from overflowing the display device frame while an acrylic board or any other transparent board is being adhered to the support frame face. Owing to the water guide groove of the support frame, water which has permeated into the main frame body is prevented from remaining in the display device frame. Furthermore, owing to the waterproof air-permeable valve, not only is heat generated from the display unit or liquid crystal screen mounted in the display device frame dissipated from the display device frame, but external water is also prevented from permeating through the air-permeable pores into the main frame body.

While the present disclosure has been described by means of specific embodiments, numerous modifications and variations could be made thereto by those skilled in the art without departing from the scope and spirit of the present disclosure set forth in the claims.

The claims are as follows:

1. A display device frame, comprising:

a main frame body made of aluminum and having an outer frame face, an inner frame face, at least an outer fin, and at least an inner fin opposing the at least an outer frame face, the at least an outer fin being integrally coupled to the outer frame face of the main frame body, the at least an inner fin being integrally coupled to the inner frame face of the main frame body, wherein at least a corner of the main frame body is joined by welding;

at least a waterproof block disposed at an upper edge or a lower edge of the welding-joined corner of the main frame body; and a support frame disposed on the inner frame face of the main frame body, the support frame having a support frame face with a board thereon, the support frame face having thereon an adhesive receiving groove filled with an adhesive;

wherein the support frame face has thereon a water guide groove disposed beside the adhesive receiving groove and positioned proximate to an edge of the support frame face.

2. The display device frame of claim 1, wherein the support frame face has thereon an adhesive overflow-proof groove disposed beside the adhesive receiving groove and positioned proximate to an inner side of the support frame face.

3. The display device frame of claim 2, wherein a height of an opening of the adhesive overflow-proof groove is less than a height of an opening of the adhesive receiving groove.

4. The display device frame of claim 1, further comprising a plurality of screen support elements disposed on the inner frame face of the main frame body.

5. The display device frame of claim 1, further comprising at least a waterproof air-permeable valve, wherein the main frame body has at least an air-permeable pore penetrating an outer frame face and an inner frame face of the main frame body, and the at least an waterproof air-permeable valve is disposed in the at least an air-permeable pore of the main frame body.

6. The display device frame of claim 1, wherein the upper edge or the lower edge of the welding-joined corner of the main frame body is joined by groove welding.

7. The display device frame of claim 1, wherein the at least an outer fin is in a plural number, and the outer fins are parallel and spaced apart.

8. The display device frame of claim 1, wherein the at least an inner fin is in a plural number, and the inner fins are parallel and spaced apart.

* * * * *